US006276559B1

(12) United States Patent
DeMars

(10) Patent No.: US 6,276,559 B1
(45) Date of Patent: Aug. 21, 2001

(54) LIQUID CONTAINER WITH PUMP AND HEAT SEALING SYSTEM

(76) Inventor: Robert A. DeMars, 23221 Ladrillo Ave., Woodland Hills, CA (US) 91367-4134

( * ) Notice: Subject to any disclaimer, the term of this patent is extended or adjusted under 35 U.S.C. 154(b) by 0 days.

(21) Appl. No.: 09/818,328

(22) Filed: Mar. 28, 2001

(51) Int. Cl.[7] ..... B65D 77/28

(52) U.S. Cl. ..... 220/707; 220/709; 222/1; 215/229

(58) Field of Search ..... 220/707, 709, 220/708; 215/229, 388; 222/1

(56) References Cited

U.S. PATENT DOCUMENTS

| | | | | |
|---|---|---|---|---|
| 3,840,153 | * | 10/1974 | Devlin | 220/709 |
| 4,684,032 | * | 8/1987 | Tsay | 220/709 |
| 5,361,934 | * | 11/1994 | Spence, Jr. | 220/707 |
| 5,484,080 | * | 1/1996 | Blasnik et al. | 220/709 |
| 5,513,762 | * | 5/1996 | Janani | 220/709 |
| 5,582,320 | * | 12/1996 | Lin | 220/709 |
| 6,050,444 | * | 4/2000 | Sugg | 220/707 |

* cited by examiner

*Primary Examiner*—Joseph M. Moy
(74) *Attorney, Agent, or Firm*—Dan M. de la Rosa

(57) ABSTRACT

A liquid container with a pump system and a heat-sealing system is provided; the container comprises a heat-retaining vessel, an upper drinking chamber, a pump device and a liquid dispensing tube for transferring the liquid from the vessel to the upper drinking chamber, and a heat-sealing device for keeping the liquid hot in the vessel.

20 Claims, 7 Drawing Sheets

LIQUID CONTAINER WITH PUMP AND HEAT SEALING SYSTEM

BACKGROUND OF THE INVENTION

1. Field of the Invention

This invention relates to a liquid container and more particularly, to a liquid container with an insulated vessel, a heat-sealing device, an upper drinking chamber and a pump system for transferring the liquid in the vessel to the drinking chamber.

2. Description of the Related Art

The consumption of hot liquids such as coffee and tea has become a common activity. Travel mugs and coffee mugs are popular consumer items. There are two common problems with drinking hot liquids and with containers that retain hot beverages. The first problem is that once the scolding hot liquid is placed in the container, the user either bums himself or herself in an effort to drink the liquid or cannot consume the liquid until it reaches an ideal drinking temperature. The second problem is that if the user leaves the container for a long period of time, the beverage becomes too cold for consumption and the user must discard the cold, stale beverage. This problem is common in the prior art because such containers expose the hot liquid to ambient during the entire time that the liquid is being consumed. This exposure to ambient causes the hot liquid to rapidly cool.

It would be desirable to provide a liquid container that is designed to dispense into a drinking chamber a small quantity of hot liquid to be then consumed while the remaining portion of the hot liquid is contained within a thermally insulated vessel that seals the heat and freshness of the beverage. It is also desirable that once the user consumes the liquid in the drinking chamber, the user can pump up another small quantity of hot liquid from the insulated vessel for consumption.

SUMMARY OF THE INVENTION

The present invention relates to a liquid container. In one embodiment, the container comprises a vessel for containing a liquid wherein the vessel has an open top and a closed bottom. In another embodiment, the container further comprises a pump device being designed to be mounted onto the vessel; the pump device has upper and lower portions and an internal cavity extending from the lower portion through the upper portion; and the lower portion comprises a protrusion extending inwardly into the cavity and forms an opening. In still anther embodiment, the container further comprises an upper drinking chamber having a cup with an internal reservoir and an external undersurface; the drinking chamber is designed to be mounted onto the pump device and the vessel; the cup is designed to fit within the cavity of the pump device, and the internal reservoir of the cup is open to ambient. In yet another embodiment, the container further comprises a first heat-sealing device being connected to the external undersurface of the cup; the first heat-sealing device is designed to seal the opening when the drinking chamber is mounted onto the pump device and the vessel. In still yet another embodiment, the container comprises a liquid dispensing tube having opposing ends, one end being attached to the drinking chamber and the second end being situated within the vessel, whereby the activation of the pump device causes pressurized air to flow into the vessel to force the liquid to flow from the vessel through the tube into the drinking chamber. The container of the present invention is designed for usage with both hot and cold liquid.

In a further embodiment, the pump device comprises a bellows. In yet a further embodiment, the container further comprises a lid wherein the lid is designed to fit onto the drinking chamber, and the lid has an aperture for drinking access. In still a further embodiment, the lid further comprises a closing mechanism for sealing the aperture. In still yet a further embodiment, the closing mechanism comprises a sliding door.

In yet another further embodiment, the drinking chamber comprises a valve and a cap for controlling the flow of the liquid. In still another further embodiment, the vessel comprises external screw threads and the retainer ring comprising internal counter threads being compatible with said screw threads of the vessel thereby mating the pump device to the vessel.

In still yet another further embodiment, the drinking chamber comprises an external sleeve. In another embodiment, the pump device is situated within the sleeve and the cup of the drinking chamber when the drinking chamber is mounted onto the pump device. In still another embodiment, an upward and downward movement of the sleeve causes the activation of the pump device. In another embodiment, the pump device has an upper annular ring and a lower retainer ring. In a further embodiment, the pump device is removably mounted onto the vessel via the retainer ring. In still a further embodiment, the upper drinking chamber is removably mounted onto the pump via the annular ring.

In yet another embodiment, the drinking chamber further comprises a stand pipe; and the tube is connected to the stand pipe, the liquid normally flowing from the tube into the stand pipe and into the internal reservoir of the cup, the liquid may flow back through the stand pipe during a recovery stroke of the pump device into the vessel thereby decreasing the overflowing of liquid in the internal reservoir of the cup. In still yet another embodiment, the upper portion of the pump device comprises external threads and the drinking chamber comprises counter threads compatible with the threads of the pump device thereby allowing the drinking chamber to mate with the pump device.

In a further embodiment, the first heat-sealing device has a diameter greater than the diameter of the opening created by the protrusion at the lower portion of the pump device. In still a further embodiment, the first heat-sealing device is constructed of a pliable and flexible material, such as a silicone. In another embodiment, the external undersurface of the cup has upper and lower parts, and the container further comprises a second heat-sealing device. In yet another embodiment, the first heat-sealing device is situated at the lower part of the undersurface and the second heat-sealing device is situated at the upper part of the undersurface of the cup, such that when the drinking chamber is mounted onto the pump device and the lower reservoir, the first and second heat-sealing devices seal the internal cavity of the pump device. In a further embodiment, the first and second heat-sealing devices are silicon rings. In still a further embodiment, the first and second heat-sealing devices are sonic welded onto the undersurface of the cup. In another embodiment, the first and second heat-sealing devices form a vapor barrier seal. In yet a further embodiment, the drinking chamber is pushed downwardly onto the pump device to thereby force the first heat-sealing device through the opening and thermally seal the open top of the vessel. In still yet a further embodiment, the drinking chamber is pulled upwardly from the pump device to pull the first heat-sealing device away through the opening and unseal the top of the vessel.

In another embodiment, the present invention relates to a method of manufacturing a liquid container. In still another embodiment, the method comprises: providing a vessel for containing a liquid wherein the vessel has an open top and a closed bottom. In yet another embodiment, the method further comprises: mounting a pump device onto the vessel, the pump device having upper and lower portions and an internal cavity extending from the lower portion through the upper portion; the lower portion comprising a protrusion extending inwardly into the cavity and forming an opening.

In a further embodiment, the method further comprises: providing an upper drinking chamber having a cup with an internal reservoir and an external undersurface, the drinking chamber being designed to be mounted onto the pump device and the vessel; the cup being designed to fit within the cavity of the pump device, and the internal reservoir of the cup being open to ambient. In still a further embodiment, the method further comprises: connecting a first heat-sealing device to the external undersurface of the cup, the heat-sealing device being designed to seal the opening when the drinking chamber is mounted onto the pump device and the vessel. In yet a further embodiment, the method further comprises: providing a liquid dispensing tube having opposing ends, one end being attached to the drinking chamber and the second end being situated within the vessel, whereby the activation of the pump device causes pressurized air to flow into the vessel to force the liquid to flow from the vessel through the tube into the drinking chamber.

In another further embodiment the method further comprises pushing the drinking chamber downwardly onto the pump device to thereby force the first heat-sealing device through the opening and thermally seal the open top of the vessel. In still another further embodiment, the drinking chamber comprises an external sleeve and pump device is situated within the sleeve and the cup of the drinking chamber when the drinking chamber is mounted onto the pump device and the method further comprises moving the sleeve in an upward and downward motion to thereby cause the activation of the pump device.

BRIEF DESCRIPTION OF THE DRAWINGS:

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION:

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
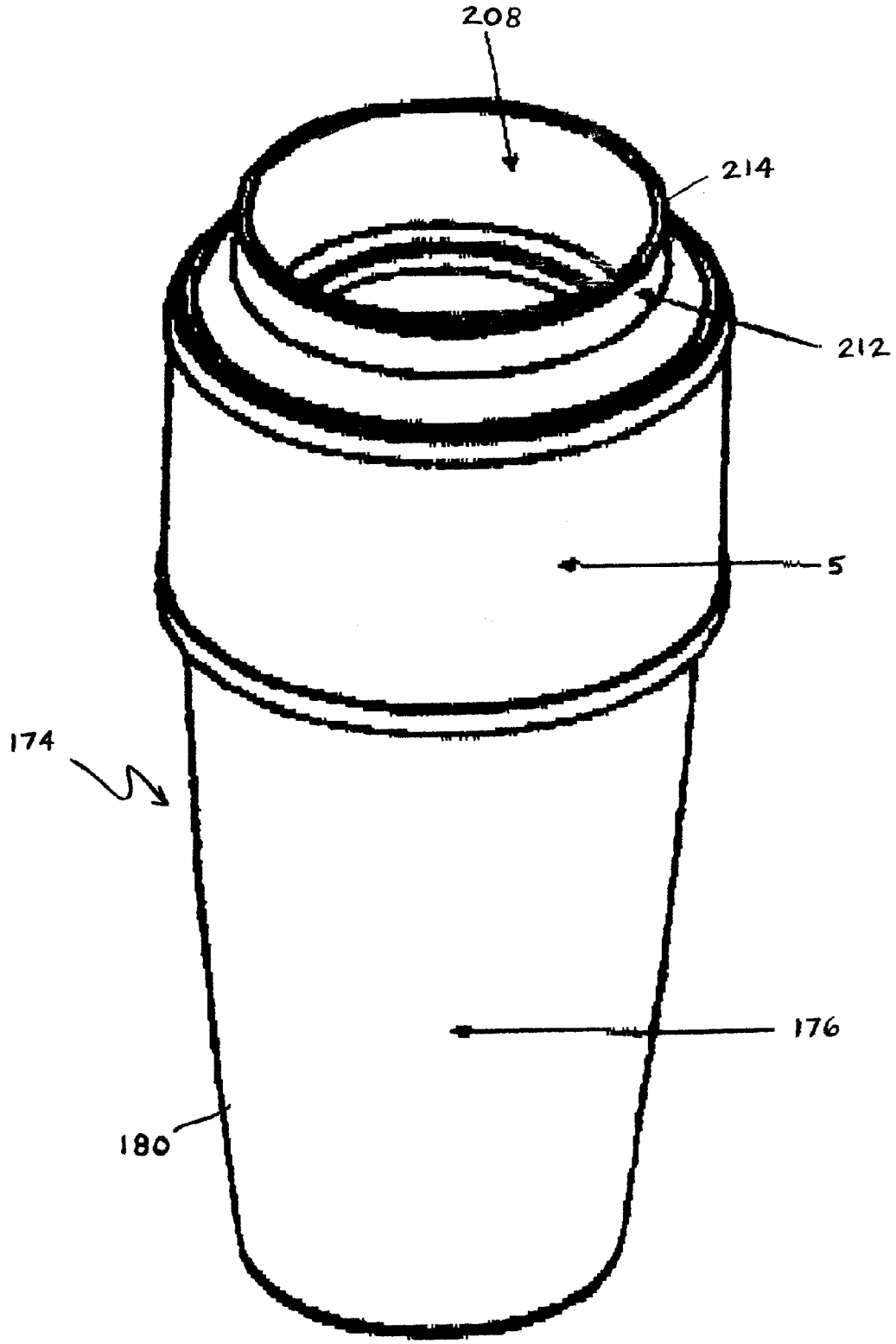
FIG. 1 is a side elevational view of one of the embodiments of the liquid container of the present invention.
Figure 2:
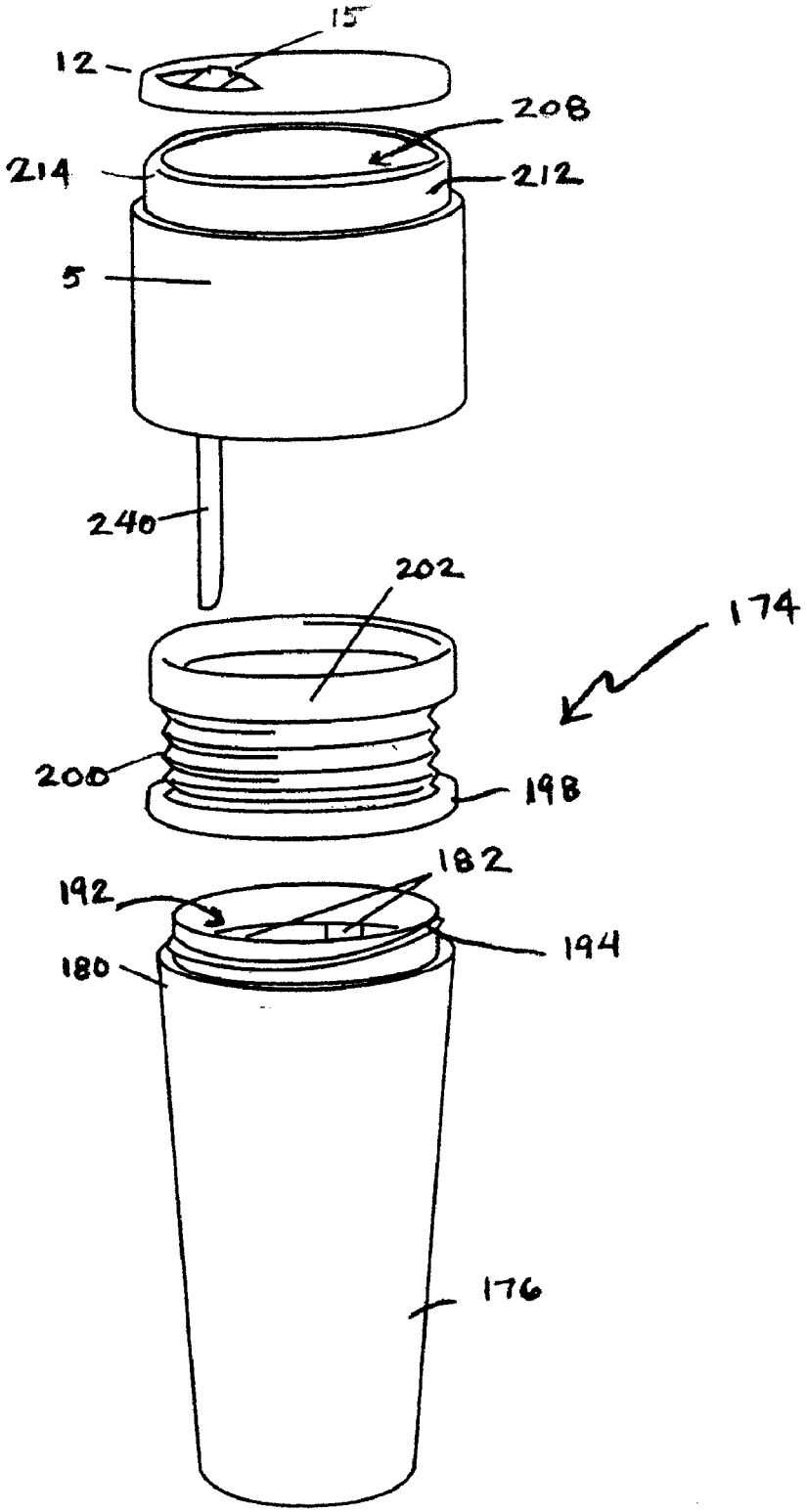
FIG. 2 is a side elevational view of the components of one of the embodiments of the present invention.
Figure 3:
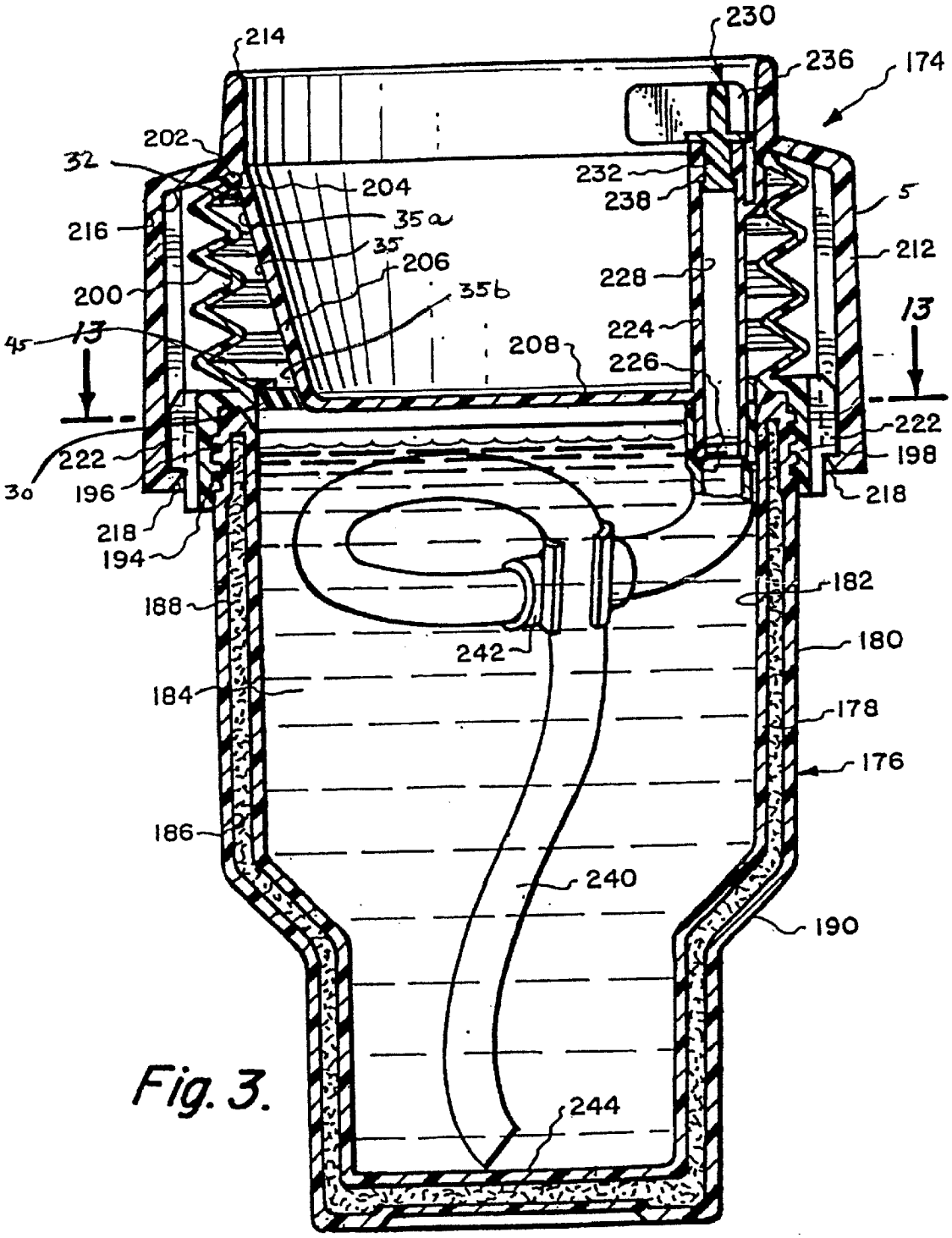
FIG. 3 is a cross-sectional view taken along line 11—11 of FIG. 6 of one of the embodiments of the present invention before the pump device is activated and the drinking chamber is empty.
Figure 4:
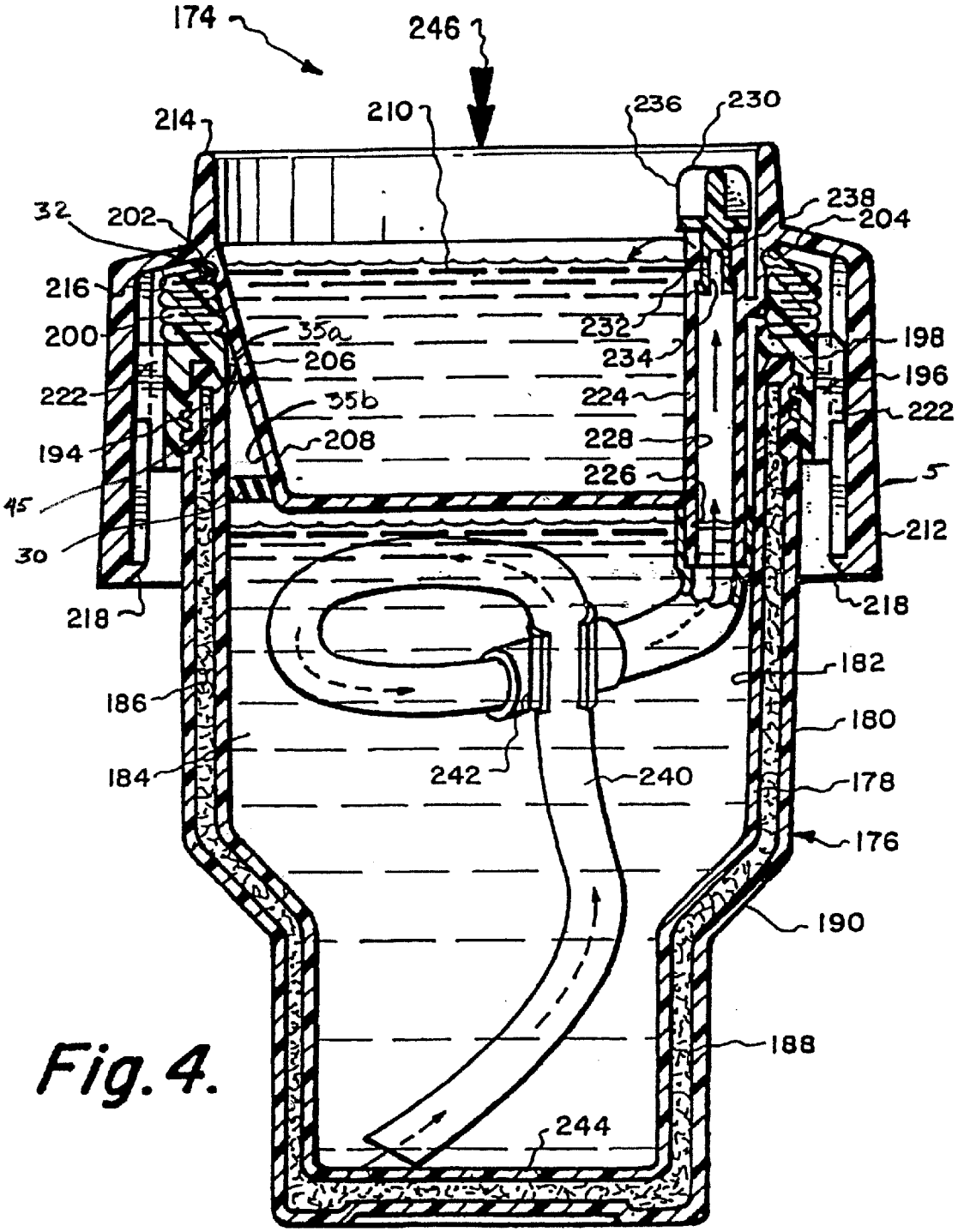
FIG. 4 is a cross-sectional view of FIG. 3 when the pump device is activated and the drinking chamber is filled with liquid.
Figure 6:
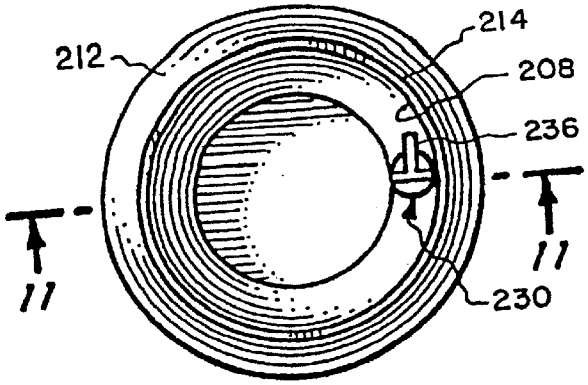
FIG. 6 is a top plan view of one of the embodiments of the present invention.
Figure 5:
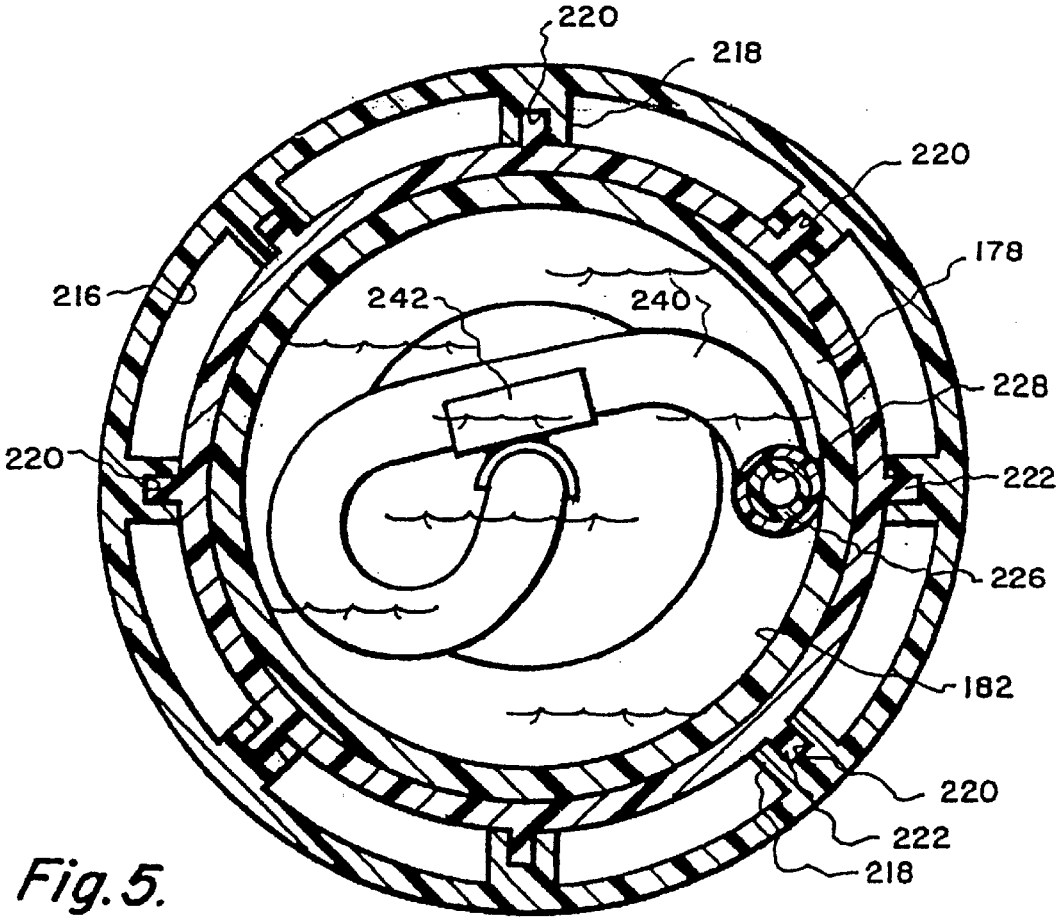
FIG. 5 is a cross-sectional view of the invention taken along line 13—13 of FIG. 3.
Figure 7:
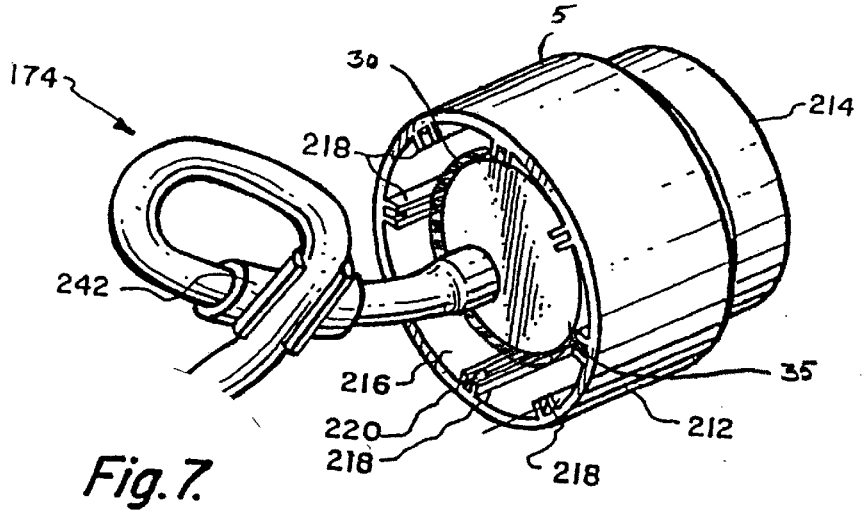
FIG. 7 is an exploded view of the undersurface of the cup of the drinking chamber and the heat-sealing device.
Figure 9:
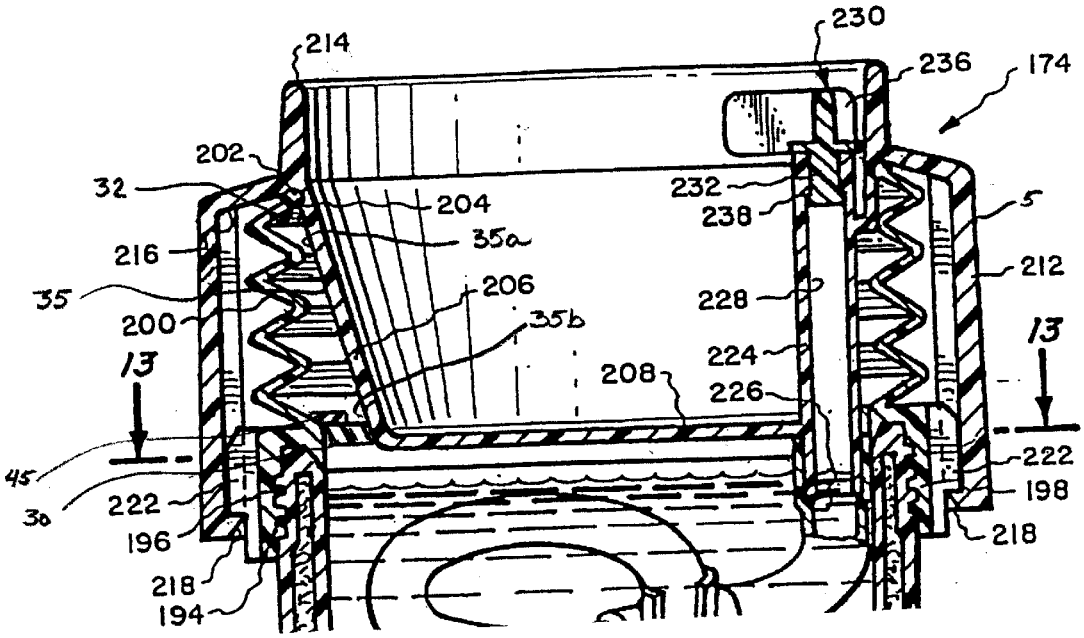
FIG. 9 is a cross-sectional view of the heat-sealing device working with the pump device and drinking chamber.
Figure 8:
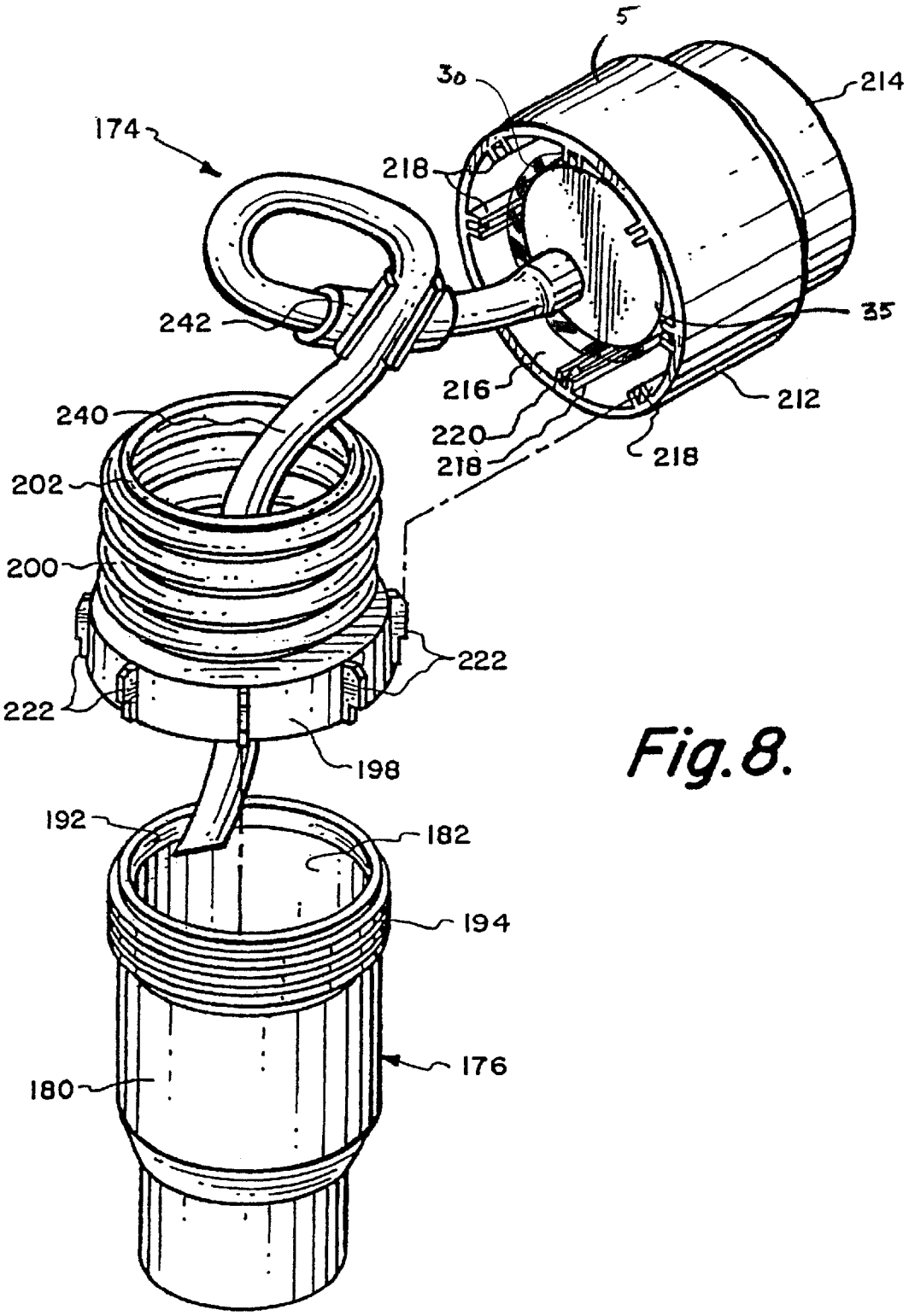
FIG. 8 is an exploded view of the components of one of the embodiments of the present invention.

Referring to FIGS. 1–2 of the drawings, there is shown one of the embodiments of the liquid container 174 of the present invention. FIG. 1 illustrates the liquid container 174 of the present invention assembled and FIG. 2 shows the container 174 of the present invention in an unassembled form. The container 174 comprises a vessel 176, a pump device 200, a drinking chamber 212 with a sleeve 5 and a tube 240, and a lid 12 with a sliding door closure 15. The vessel 176 has an outer wall 180 with screw threads 194 at the upper end of the vessel 176 and an access opening 192 leading to an internal chamber 182. The pump device 200 having an annular ring 202 and a retainer ring 198. In one embodiment, the pump device 200 comprises a bellows. The upper drinking chamber 212 has an annular flange 214 and a consuming internal reservoir 208. The drinking chamber 212 is attached to a sleeve 5 for allowing the user to grasp the container 174. For usage purposes, a consumable liquid 184 is placed within the internal chamber 182 of the vessel 176, not to exceed a fill line of the vessel. The pump device 200 is attached to the vessel 176 by twisting the threads of the retainer ring 198 onto the threads 194 of the vessel 176, thereby mating the vessel 176 to the pump device 200. In another embodiment, the pump device 200 is attached to the vessel before the vessel 176 is filled with the consumable liquid 184. Once filled, the container 174 is sealed by pushing the drinking chamber 212 downward onto the pump device 200, allowing the tube to be situated within the vessel 176 and twisting the upper drinking chamber 212 clockwise to secure the upper chamber 212 onto the pump device 200 and the vessel 176. By pushing the chamber 212 onto the pump device 200, the heat-sealing device 30 covers the opening of the pump device 200 leading to the access opening 192 of the vessel 176. In another embodiment, the heat-sealing device 30 is a gasket. The spill resistant lid 12 is securely snapped onto the upper drinking chamber 212 near the annular flange 214. The user may then grasp the sides of the sleeve 5 and pump as many times as needed to fill the upper drinking chamber 212 with the desired amount of liquid 184. In one embodiment, the sleeve 5 may be pumped at least three times to obtain the desired amount of liquid in the upper chamber 212. In still another embodiment, the sliding door 15 of the lid 12 may be left open during the pumping of the liquid. In yet another embodiment, the lid may be left off of the upper chamber 212 during the pumping of the liquid and the liquid may be consumed from the annular flange 214 of the upper chamber 212. In still yet another embodiment, the lid may be left on and the user may drink from the opening of the lid 12. To release the seal, the upper chamber 212 is twisted counter-clockwise and then gently pulled upwards from the pump device 200. In a further embodiment, the tube 240 is removable from the upper chamber 212 and the components of the container 174 of the present invention are dishwasher safe.

Referring to FIGS. 3–9 of the drawings, there is depicted other embodiments of the present invention. The container 174 includes a vessel 176, which is composed of an inner wall 178 and an outer wall 180. The inner wall 178 includes an internal chamber 182. Within the internal chamber 182 is to be located a volume of a liquid beverage 184 such as coffee or tea. Both inner and outer walls, 178 and 180 respectively, may be constructed of sheet plastic material. There is a void 186 located between the inner wall 178 and the outer wall 180. The void 186 is to be filled with a thermally insulating material such as rigid plastic foam.

The inner wall 178 is located parallel to the outer wall 180. In one embodiment, both the inner wall 178 and the outer wall 180 are necked down at their base forming a necked down area 190, which results in the forming of a smaller diameter section. The reason for the smaller diameter section is to permit the container 174 to be placed within most conventionally designed beverage container holders. The design allows the container 174 of the present invention to be ideal for traveling.

The internal chamber 182 is opened at the upper end of the vessel 176 by means of an access opening 192. The outer wall 180 in the area directly adjacent this access opening 192 includes a series of external screw threads 194. Screw threads 194 are to be connectable with the series of internal screw threads 196 formed on a retainer ring 198 of the pump device 200. The retainer ring 198 is normally constructed of a plastic material. Integrally connected and extending from the retainer ring 198 is an accordion shaped pump device 200. The accordion shaped pump device 200 comprises a bellows. The retainer ring 198 has an internal protrusion 45 that extends inwardly into the cavity within the pump device 200 and forms an opening. The outer end of the accordion shaped pump device 200 is formed into an annular ring 202. This annular ring 202 is to snap within an annular groove 204 formed within the exterior surface of a reservoir wall 206. The reservoir wall 206 defines an internal chamber in the form of a consuming reservoir 208. This consuming reservoir 208 is capable of containing a quantity of consumable liquid 210.

The reservoir wall 206 is integrally connected to an upper drinking chamber 212. The upper drinking chamber 212 has a cup with an internal reservoir 208 and an external undersurface 35. The drinking chamber 212 is designed to be mounted onto the pump device 200 and the vessel 176; the cup is designed to fit within the cavity of the pump device 200, and the internal reservoir 208 of the cup is open to ambient. The container 174 further comprises a first heat-sealing device 30 being connected to the external undersurface 35 of the cup; the first heat-sealing device 30 is designed to seal the opening when the drinking chamber 212 is mounted onto the pump device 200 and the vessel 176. In one embodiment, the fast heat-sealing device 30 has a diameter greater than the diameter of the opening created by the protrusion 45 at the lower portion of the pump device 200. In still a further embodiment, the first heat-sealing device 30 is constructed of a pliable and flexible material. In another embodiment the undersurface 35 of the cup has upper and lower parts, 35*a* and 35*b* respectively, and the container 174 further comprises a second heat-sealing device 32. In still another embodiment, the first heat-sealing device 30 is situated at the lower part 35*b* and the second heat-sealing device 32 is situated at the upper part 35*a* of the undersurface 35 of the cup, such that when the drinking chamber 212 is mounted onto the pump device 200 and the vessel 176, the first and second heat-sealing devices, 30 and 32 respectively, seal the internal cavity of the pump device 200. In yet a further embodiment, the drinking chamber 212 is pushed downwardly onto the pump device 200 to thereby force the first heat-sealing device 30 through the opening and thermally seal the open top of the vessel 176. In still yet a further embodiment, the drinking chamber 212 is pulled upwardly from the pump device 200 to pull the first heat-sealing device 30 away through the opening and unseal the top of the vessel 176.

In a further embodiment, the upper drinking chamber 212 is open at its upper end within the confines of an annular flange 214 with the opening defined by the annular flange 214 functioning as a dispensing opening for the consumable liquid 210. There is an annular space 216 located between the exterior surface of the reservoir wall 206 and the interior surface of the drinking chamber 212. Located within this space 216 and fixedly secured to the interior wall surface of the chamber 212 is a plurality of rails 218. There are eight in number of the rails 218 with it being understood that the number of the rails 218 could be increased or decreased without departing of the inventive aspects of the present invention. The rails 218 are located in a circular pattern and are evenly spaced apart. Each rail 218 includes a longitudinal groove 220. The length of each of the grooves 220 is substantially equal to the depth of the annular space 216.

Fixedly mounted on the exterior surface of the retainer ring 198 is a plurality of protuberances 222. There are eight in number of the protuberances with the spacing between directly adjacent protuberances 222 being approximately equal to the spacing between the rails 218. A protuberance 222 is to connect with a groove 220 with there being a protuberance 222 connecting with each groove 220. Annular ring 202 is snapped in position within the groove 204. In another embodiment, the chamber 212, the accordion shaped pump device 200 and the retainer ring 198 may all connect together as a single unit. However, the chamber 212 is capable of being moved relative to the retainer ring 198 and vessel 176 compressing and expanding the accordion shaped pump device 200.

Integrally formed in conjunction with the reservoir wall 206 is a stand pipe 224. The stand pipe 224 includes a short extension 226 protruding from the undersurface of the reservoir wall 206. The stand pipe 224 includes a through opening 228. Mounted within the upper end of the through opening 228 and located on the stand pipe 224 is a valve 230. The valve 230 has a tubular member 232, which is located in a snug fitting manner within through opening 228. The tubular member 232 includes a pair of diametrically located opposite slits 234. The valve 230 also includes a manually engage able handle 236. The handle 236 can be used to apply rotative pressure to the valve 230 which will cause the tubular member 232 to pivot within the through opening 228. This pivoting can be so as to locate the slits 234 in the position shown in FIG. 3, which will permit the beverage 184 to flow through one of the slits 234 and then through slot 238 formed within the stand pipe 224 into the consuming reservoir 208. The valve 230 can also be pivoted to a position that neither slit 234 aligns with the slot 238 which will then prevent the flow of any liquid from the through opening 228 into the consuming reservoir 208. It is noted that the exit of the stand pipe 224 is always at or above the surface of the liquid 210 so liquid 210 will normally only flow from the stand pipe 224 to the reservoir 208. If overfilling of reservoir 208 occurs, the excess liquid 210 will flow through stand pipe 224 back into the internal chamber 182. In a further embodiment, the valve may include a mushroom cap.

One end of a flexible tube 240 is mounted in a liquid tight manner over the short extension 226. This flexible tube 240 is held in a looped configuration by means of a clip 242. One purpose of the clip 242 is to locate the bottom end of the flexible tube 240 directly adjacent the bottom 244 of the inner wall 178. The clip 242 permits adjusting of the position of the bottom end of the flexible tube 240 to be located directly adjacent the bottom 244.

With the upper drinking chamber 212 and the retainer ring 198 disengaged from the threads 194, the desired quantity of liquid 184 is to be supplied within the internal chamber 182. The upper chamber 212 and the retainer ring 198 are then tightly fastened onto the threads 194. The valve 230 is manually turned by handle 236 so that one of the slits 234 aligns with the slot 238. The user then grasps the drinking chamber 212 and manually applies pressure in a downward direction as depicted by arrow 246, which constitutes the positive stroke. The air that is contained within the internal chamber 182, and located above the beverage 184, is compressed with this air pressure being applied to the surface of the beverage 184. This positive stroke will cause some of the beverage to flow through the flexible tube 240, through the slit 234 and the slot 238 into the consuming reservoir 208. After the pump device 200 is totally compressed, the upper chamber 212 is retracted upwardly (recovery stroke) causing expansion of the accordion shaped sleeve 200 from the collapsed state shown FIG. 4 to the expanded state of FIG. 3 which will cause an enlargement of the volume of the internal chamber 182. Air is permitted to pass through the slot 238 and the slit 234 through the flexible tube 240 into the internal chamber 182. Reapplication of the positive stroke on the upper chamber 212 will again cause pressurization of the air located within internal chamber 182 and cause a further quantity of the beverage 184 to be conducted into the consuming reservoir 208. This procedure is repeated until the desired quantity of consumable liquid 210 has been located within the consuming reservoir 208. The user can then, if desired, turn the valve 230 by means of the handle 236 which will prevent flow of liquid from the tube 240 into the consuming reservoir 208. The user can then consume the consumable liquid 210 in a normal manner. When the consumable liquid 210 has been consumed, the valve 230 can be moved to align a slit 234 with the slot 238 which will then permit more of the beverage 184 to flow into the consuming reservoir 208 by repeated positive strokes of the cap 212 collapsing the accordion shaped pump device 200 which functions as a bellows.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A liquid container comprising:

a vessel for containing a liquid, said vessel having an open top and a closed bottom;

a pump device being designed to be mounted onto said vessel, said pump device having upper and lower portions and an internal cavity extending from said lower portion through said upper portion, said lower portion comprising a protrusion extending inwardly into said cavity and forming an opening;

an upper drinking chamber having a cup with an internal reservoir and an external undersurface, said drinking chamber being designed to be mounted onto said pump device and said vessel, said cup being designed to fit within said cavity of said pump device, said internal reservoir of said cup being open to ambient;

a first heat-sealing device being connected to said external undersurface of said cup, said first heat-sealing device being designed to seal said opening when said drinking chamber is mounted onto said pump device and said vessel; and a liquid dispensing tube having opposing ends, one end being attached to said drinking chamber and said second end being situated within said vessel, whereby the activation of said pump device causes pressurized air to flow into said vessel to force the liquid to flow from said vessel through said tube into said drinking chamber.

2. The container of claim 1 wherein said pump device comprises a bellows.

3. The container of claim 1 further comprises a lid, said lid being designed to fit onto said drinking chamber, said lid having an aperture for drinking access.

4. The container of claim 3 wherein said lid further comprises a closing mechanism for sealing said aperture.

5. The container of claim 4 wherein said closing mechanism comprises a sliding door.

6. The container of claim 1 wherein said drinking chamber comprises a valve and a cap for controlling the flow of the liquid.

7. The container of claim 1 wherein said pump device comprises a retainer ring positioned at the lower portion of said pump device and an annular ring positioned at the top of said pump device.

8. The container of claim 7 wherein said vessel comprises external screw threads and said retainer ring comprising internal counter threads being compatible with said screw threads of said vessel thereby allowing said pump device to mate with said vessel.

9. The container of claim 1 wherein said drinking chamber comprises an external sleeve.

10. The container of claim 9 wherein said pump device is situated within said sleeve and said cup of said drinking chamber when said drinking chamber is mounted onto said pump device.

11. The container of claim 10 wherein an upward and downward movement of said sleeve causes the activation of said pump device.

12. The container of claim 1 wherein said drinking chamber further comprises a stand pipe, said tube being connected to said stand pipe, the liquid normally flowing from said tube into said stand pipe and into said internal reservoir of said cup, the liquid may flow back through said stand pipe during a recovery stroke of said pump device into said vessel thereby decreasing the overflowing of liquid in said internal reservoir of said cup.

13. The container of claim 7 wherein said annular ring of said pump device comprises external threads and said drinking chamber comprises counter threads compatible with said threads of said annular ring thereby allowing said drinking chamber to mate with said pump device, said drinking chamber being removably mounted on said annular ring.

14. The container of claim 1 wherein said first heat-sealing device having a diameter greater than the diameter of the opening created by said protrusion at said lower portion of said pump device.

15. The container of claim 1 wherein said external undersurface of said cup has upper and lower parts; said container further comprising a second heat-sealing device, said first heat-sealing device being situated at said lower part and said second heat-sealing device being situated at said upper part of said external undersurface of said cup such that when said drinking chamber is mounted onto said pump device and said vessel, said first and second heat-sealing device seal said internal cavity of said pump device.

16. The container of claim 14 wherein said drinking chamber is pushed downwardly onto said pump device to thereby force said first heat-sealing device through said opening and thermally seal said open top of said vessel.

17. The container of claim 16 wherein said drinking chamber is pulled upwardly from said pump device to pull said first heat-sealing device away through said opening and unseal said top of said vessel.

18. A method of manufacturing a liquid container, said method comprising:

providing a vessel for containing a liquid, said vessel having an open top and a closed bottom;

mounting a pump device onto said vessel, said pump device having upper and lower portions and an internal cavity extending from said lower portion through said upper portion, said lower portion comprising a protrusion extending inwardly into said cavity and forming an opening;

providing an upper drinking chamber having a cup with an internal reservoir and an external undersurface, said drinking chamber being designed to be mounted onto said pump device and said vessel, said cup being designed to fit within said cavity of said pump device, said internal reservoir of said cup being open to ambient;

connecting a first heat-sealing device to said external undersurface of said cup, said heat-sealing device being designed to seal said opening when said drinking chamber is mounted onto said pump device and said vessel; and providing a liquid dispensing tube having opposing ends, one end being attached to said drinking chamber and said second end being situated within said vessel, whereby the activation of said pump device causes pressurized air to flow into said vessel to force the liquid to flow from said vessel through said tube into said drinking chamber.

19. The method of claim 18 further comprising pushing said drinking chamber downwardly onto said pump device to thereby force said heat-sealing device through said opening and thermally seal said open top of said vessel.

20. The method of claim 18 wherein said drinking chamber comprises an external sleeve and said pump device is situated within said sleeve and said cup of said drinking chamber when said drinking chamber is mounted onto said pump device and said method further comprises moving said sleeve in an upward and downward motion to thereby cause the activation of said pump device.

* * * * *